US005785616A

United States Patent [19]

Dodge

[11] Patent Number: 5,785,616

[45] Date of Patent: Jul. 28, 1998

[54] BARRIER SYSTEM FOR A BASKETBALL GOAL

[76] Inventor: Richard C. Dodge, 10816 Brandy Oak Run, Fort Wayne, Ind. 46845

[21] Appl. No.: 438,521

[22] Filed: May 10, 1995

[51] Int. Cl.[6] ..... A63B 63/08

[52] U.S. Cl. ..... 473/479

[58] Field of Search ..... 273/1.5 R; 473/197, 473/479, 481, 483, 484

[56] References Cited

U.S. PATENT DOCUMENTS

| | | | |
|---|---|---|---|
| 2,932,511 | 4/1960 | Bemsi | 473/481 |
| 3,388,909 | 6/1968 | Woods | 273/1.5 |
| 3,602,504 | 2/1969 | Chapman | 273/105 R |
| 3,752,476 | 8/1973 | Mahoney | 273/105 A |
| 3,776,549 | 12/1973 | Ganis | 473/483 |
| 3,901,506 | 8/1975 | Caveney | 273/105 A |
| 4,045,032 | 8/1977 | Cox | 473/197 |
| 4,188,031 | 2/1980 | Fox | 273/26 A |
| 4,511,146 | 4/1985 | Windall | 473/197 X |
| 4,595,199 | 6/1986 | Offutt | 273/1.5 A |
| 4,762,319 | 8/1988 | Krumholz | 273/1.5 R |
| 4,786,053 | 11/1988 | Barnes, Jr. | 273/1.5 R |
| 4,911,443 | 3/1990 | Foster | 273/55 D |
| 4,969,651 | 11/1990 | Comartin | 273/410 |
| 5,016,875 | 5/1991 | Joseph | 273/1.5 A |
| 5,124,899 | 6/1992 | Hale | 273/1.5 R |
| 5,129,648 | 7/1992 | Sweeney | 275/1.5 A |
| 5,180,167 | 1/1993 | Felix | 473/197 |
| 5,312,099 | 5/1994 | Oliver, Sr. | 273/1.5 A |
| 5,333,853 | 8/1994 | Hektor | 273/1.5 A |
| 5,364,091 | 11/1994 | Sebek | 273/1.5 A |
| 5,402,999 | 4/1995 | Keehn, Sr. | 273/1.5 R |

OTHER PUBLICATIONS

Abstract of SU 1319-878-A.

The Sporting Goods Dealer, Jun. 1975, p. 61.

*Primary Examiner*—William H. Grieb

*Attorney, Agent, or Firm*—Taylor & Associates, P.C.

[57] ABSTRACT

The present invention provides a barrier apparatus for operation with a standing basketball goal pole, backboard and hoop. The barrier apparatus comprises a large net attached to a horizontal pole that is connected to a vertical basketball goal pole. The barrier net hangs from the horizontal pole and is staked to the ground. The system intercepts missed balls that are directed at the backboard or hoop and returns them to the playing court.

12 Claims, 2 Drawing Sheets

BARRIER SYSTEM FOR A BASKETBALL GOAL

BACKGROUND OF THE INVENTION

1. Field of the Invention

The present invention relates to a barrier system for a basketball goal, and, more particularly, to such a barrier system for outdoor basketball goals.

2. Description of the Related Art

A problem with conventional basketball goals is that shots taken by a player often miss the target, thereby causing the ball to travel beyond the court area, and therefore inducing a player to chase the errant ball. This creates an unsafe environment for children should the court be adjacent to a street. The missed shot and chase also cause the trampling of the grounds and abuse to shrubs and flowers in the path of the ball and running children.

What is needed in the art is a barrier system that is adaptable to pre-installed basketball goals to reduce the likelihood of a chase behind the goal of an errantly thrown basketball.

SUMMARY OF THE INVENTION

The present invention provides a barrier apparatus for operation with a free-standing basketball pole, board and hoop. The barrier apparatus comprises a large net attached to a horizontal pole that is attached to a vertical basketball goal pole. The barrier net hangs from the horizontal pole and is staked to the ground. The system intercepts missed balls that are directed at the target and returns them to the playing court.

An advantage of the present invention is that it reduces foot and ball traffic behind the target, therefore protecting lawns, decorative flowers and shrubs.

Another advantage of the present invention is that it reduces the likelihood of missed balls bouncing into nearby streets, thereby increasing the safety of the children who might have to retrieve a ball that missed the backboard.

Yet another advantage of the present invention is that the netting and black colored metal fixtures discretely blend into any environment.

A further advantage of the present invention is that the net of the system creates a trampoline effect when hit by a ball that often returns the ball directly to the shooter after a missed shot.

Another advantage of the present system is that it easily attaches to most any pre-existing standard basketball post, thereby requiring no auxiliary permanent framing.

The invention, in-one form thereof, comprises a barrier apparatus for outdoor basketball systems having a ground-mounted pole with an attached basketball backboard. The barrier apparatus includes a net connected to the pole above the backboard and extends above and below the backboard whereby areas behind the backboard are shielded from errant basketballs.

The invention, in another form thereof, comprises a barrier apparatus for outdoor basketball systems having a ground mounted pole with an attached basketball backboard. The barrier apparatus includes a net connected to the pole, the net extending above and below the backboard. Pegs or stakes are connected to the net and adapted to be disposed in the ground so that the net hangs taut behind the backboard to the ground, whereby areas behind the backboard are shielded from errant basketballs.

In yet another form of the invention, a vertical pole extension is attachable to the ground mounted basketball pole so that a portion of the vertical pole extension extends above the backboard to thereby permit the net to hang from a point above the backboard.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates a preferred embodiment of the invention, and such exemplification is not to be construed as limiting the scope of the invention in any manner.

DETAILED DESCRIPTION OF THE INVENTION

Figure 1:
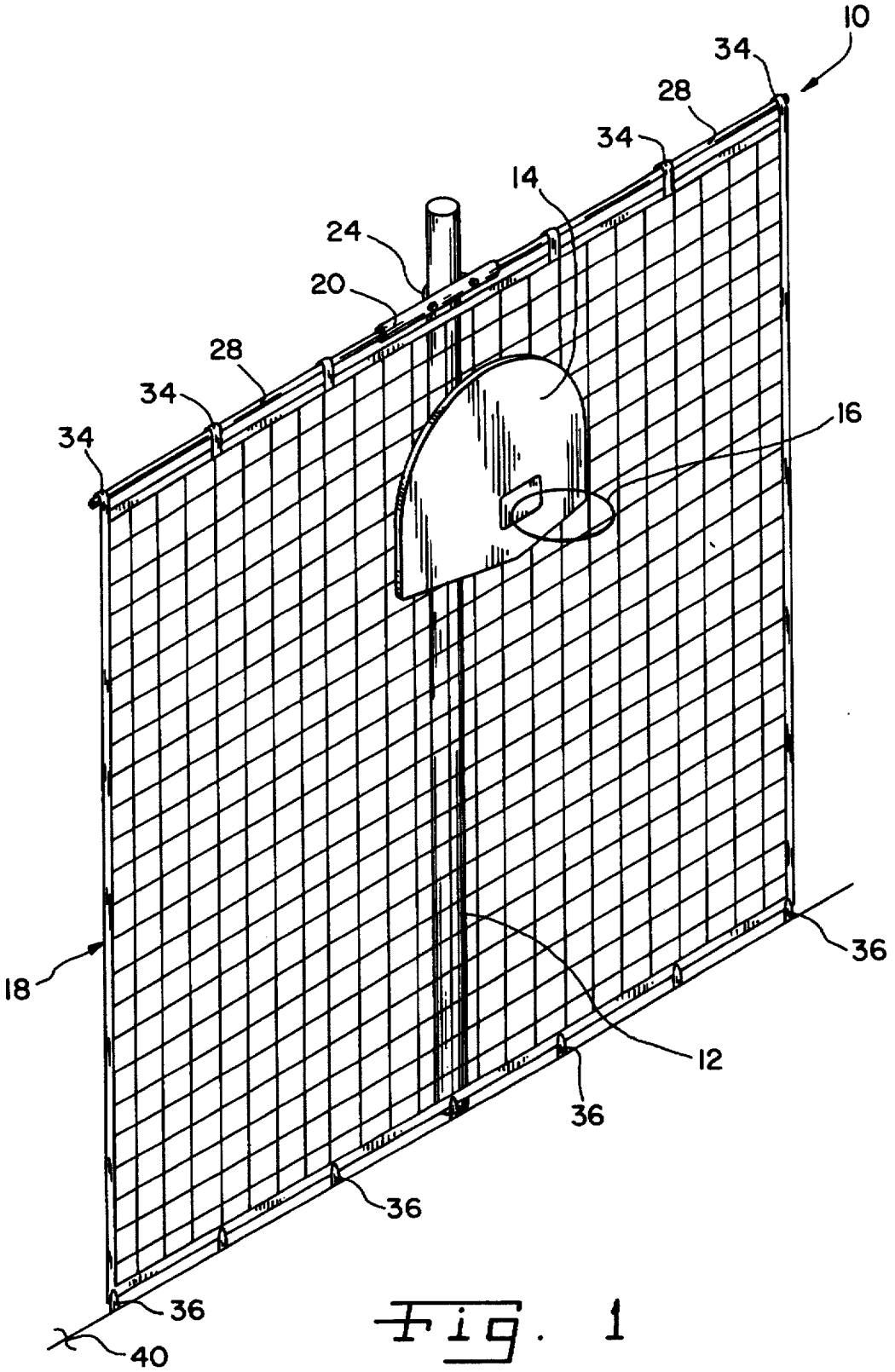
FIG. 1 is a perspective view of one form of the present invention.

Referring now to FIG. 1, there is shown a perspective front view of the barrier system 10 of the present invention. System 10 is adapted for use with a vertically mounted basketball post 12 having an attached backboard 14 and basketball rim 16.

Figure 2:
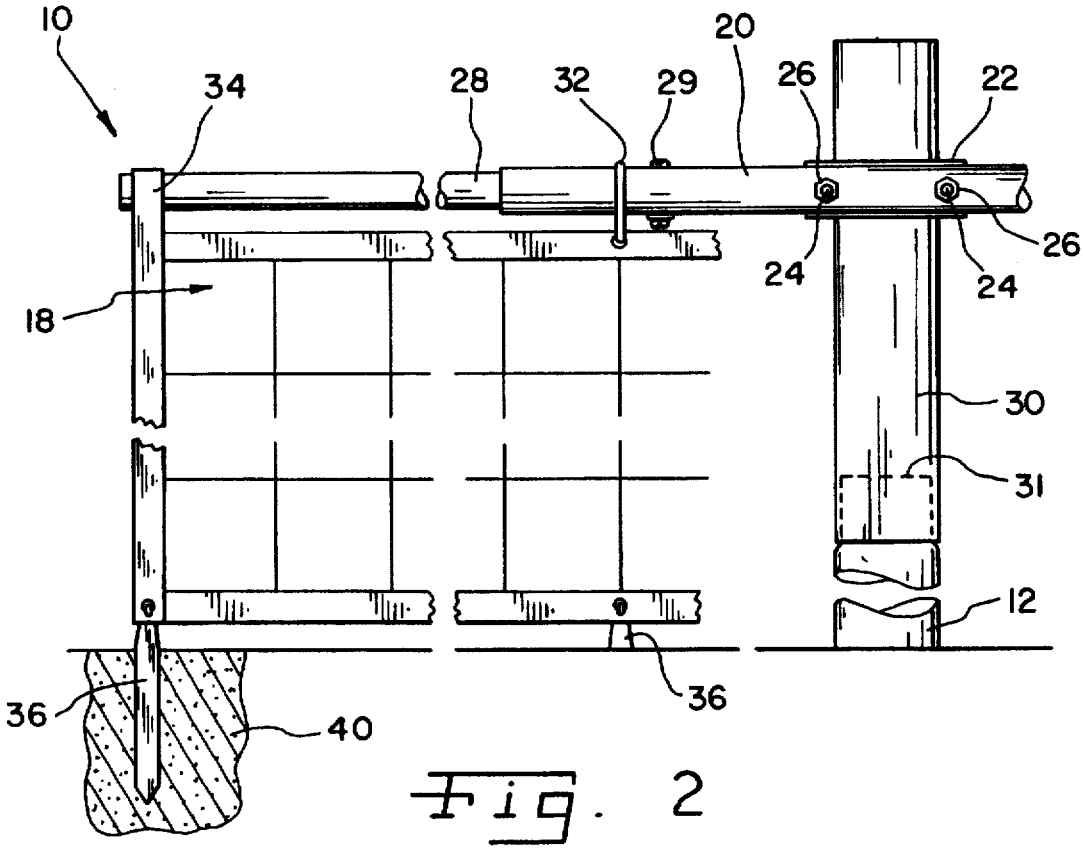
FIG. 2 is a fragmentary front elevational view of another form of the invention.

System 10 utilizes a net 18 connected to post 12 above basketball backboard 14, to capture errantly thrown basketballs. Net 18 is preferably constructed from a 12×12 foot polyester square mesh net as shown in FIGS. 1 and 2. Although shown in the drawings as having a typical four (4) inch square mesh, other sizes and type of mesh materials may be utilized.

Figure 3:
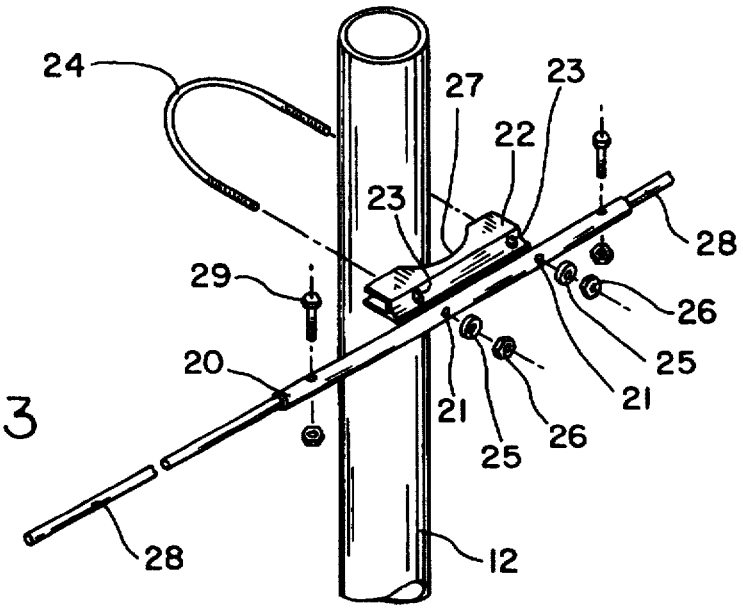
FIG. 3 is an exploded perspective view of the horizontal pole and bracket of the invention attachable to a vertical pole.

In one embodiment, a horizontal extension pole 20 is connected to post 12 by means of a bracket 22 (FIGS. 2 and 3). This bracket 22 utilizes a U-bolt 24 that passes about post 12 and through openings 23 on opposite sides of bracket 22. U-bolt 24 further passes through holes 21 in extension pole 22 and is thereby secured by washers 25 and nuts 26. Bracket 22 additionally includes a curved or contoured surface 27 that engages post 12 when U-bolt 24 is firmly attached. Curved surface 27 ensures a non-slip grip between bracket 22 and post 12 when system 10 is connected.

Horizontal extension pole 20 includes detachable extension portions 28, attached by bolts 29, which permit horizontal extension pole 20 to be collapsed for shipping and sale (FIG. 3). Other attachment or collapsing means, such as telescoping rod segments, may be utilized to shorten the length of pole 20 for transport.

For additional protection, if post 12 does not extend far enough above basketball backboard 14 as shown in FIG. 1, a vertical extension pole cap 30 is utilized to permit net 18 to be hung higher above backboard 14. FIG. 2 discloses vertical extension pole cap 30 which is sized to fit about a tapered end 31 of basketball post 12. Alternatively, it would be possible to reverse the connection such that vertical extension pole cap 30 would include a tapered end (similar to end 31) which would interfit and lock within basketball post 12. Additionally, other connection mechanisms such as lock pins, bolts, or even snap fittings may be utilized so that vertical extension pole cap 30 is vertically aligned with basketball post 12. In this embodiment, horizontal extension pole 20 would be connectable with vertical extension pole 30, as shown in FIG. 2.

Vertical extension pole cap 30, horizontal extension pole 20, bracket 22 and associated attachment hardware are preferably formed of metal. These metal parts may be coated with heat-treated enamel black paint to withstand exposure to weather and reduce their visibility.

Net 18 may be attached between horizontal extension pole 20 and ground 40 to extend above and below backboard 12 in a plurality of different ways. As shown in FIG. 2, oval or round grommets 32 may be spaced along a top portion of net 18. These grommets 32 are used to hang net 18 from both horizontal extension pole 20 and extension portions 28, if any. Another mechanism for connecting net 18 to horizontal extension pole 20 includes the use of a strap 34, having hook and loop fasteners such as a VELCRO ™ strap as shown in FIG. 1. Other mechanisms such as ties, strings, or spring clips may also be equivalently utilized to attach and hang net 18 from extension pole 20.

To ensure stable placement and location of net 18 during use, the bottom portion of net 18 may be stabilized as well. As shown in FIG. 2, stakes or pegs such as polycarbonate tent pegs 36 are attached to the bottom portion of net 18 and adapted to be staked, pounded, or disposed into ground 40. Pegs 36 are hammered into ground 40 until the net 18 becomes taut.

In operation, barrier system 10 will hang behind backboard 12 waiting for a missed shot. On a missed shot, the basketball will impact net 18, and will be bounced back into the playing court instead of traveling out behind backboard 12.

Barrier system 10 will stop most balls that are directed at but miss basketball backboard 14. As is evident with use of net 18, the area immediately behind barrier system 10, will have reduced traffic from missed shots and players retrieving such missed shots, thus preventing damage to lawns, flowers, and shrubs possibly behind backboard 14. Additionally, net 18 keeps the ball confined to the court area, thus reducing chases of the ball in traffic prone areas.

The action of net 18, if taut, additionally acts as a vertical trampoline to return the ball to the shooter after a missed shot. The present system may be used as an add-on to a preexisting, free-standing basketball post, either of the type cemented or mounted into the ground or to basketball goal systems on a transportable platform.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A barrier system for outdoor basketball systems having a ground mounted pole with an attached basketball backboard, said barrier system comprising:

a horizontal pole separate from the backboard and detachably connected to the pole at a location above the backboard; and a net connected to the horizontal pole at a plurality of locations above the backboard, said net extending above and below the backboard, whereby areas behind the backboard are shielded from errant basketballs.

2. The barrier system of claim 1 further comprising stakes for interconnecting to said net with the ground whereby said net hangs from above the backboard to the ground.

3. The barrier system of claim 1 in which said horizontal pole includes detachable extensions that increase the length of said horizontal pole.

4. The barrier system of claim 1 in which said net is attached to said horizontal pole with a strap having hook and loop fasteners.

5. The barrier system of claim 1 in which said net is substantially square.

6. A barrier system for outdoor basketball systems having a ground mounted pole with an attached basketball backboard, said barrier system comprising:

a horizontal pole separate from the backboard and detachably connected to the pole at a location above the backboard;

a net connected to the horizontal pole at a plurality of locations above the backboard, said net extending above and below the backboard; and stakes connected to said net and adapted to be disposed in the ground so that said net hangs behind the backboard to the ground, whereby areas behind the backboard are shielded from errant basketballs.

7. The barrier system of claim 6 in which said horizontal pole includes detachable extensions that increase the length of said horizontal pole.

8. A barrier system for outdoor basketball systems having a ground mounted pole with an attached basketball backboard extending above the pole, said barrier system comprising:

a vertical pole extension attachable to the ground mounted pole so that a portion of said vertical pole extension extends above the backboard;

a horizontal pole separate from the backboard and detachably connected to said vertical pole extension at a location above the backboard; and a net connected to the horizontal pole at a plurality of locations above the backboard, said net extending above and below the backboard whereby areas behind the backboard are shielded from errant basketballs.

9. The barrier system of claim 8 in which stakes are connected to said net and adapted to be disposed in the ground, whereby said net hangs from above the backboard to the ground.

10. The barrier system of claim 8 in which said horizontal pole includes detachable extensions that increase the length of said horizontal pole.

11. The barrier system of claim 8 in which said net is attached to said horizontal pole with a strap having hook and loop fasteners.

12. The barrier system of claim 8 in which said net is substantially square.

* * * * *